United States Patent [19]

Kawagoe et al.

[11] Patent Number: 4,923,232

[45] Date of Patent: May 8, 1990

[54] WINDOW APPARATUS FOR VEHICLE

[75] Inventors: Shigeyuki Kawagoe, Anjo; Yoshikatu Furuya, Toyota, both of Japan

[73] Assignee: Aisin Seiki Kabushiki Kaisha, Japan

[21] Appl. No.: 403,009

[22] Filed: Sep. 6, 1989

Related U.S. Application Data

[63] Continuation of Ser. No. 114,009, Oct. 29, 1987, abandoned.

[30] Foreign Application Priority Data

Oct. 30, 1986 [JP] Japan ..... 61-259353
Oct. 30, 1986 [JP] Japan ..... 61-259354

[51] Int. Cl.[5] ..... E05C 17/34

[52] U.S. Cl. ..... 292/263; 292/DIG. 5; 296/201; 49/465

[58] Field of Search ..... 292/262, 263, DIG. 6, 292/DIG. 5, DIG. 49; 49/465, 394; 70/89; 296/224, 218, 201; 98/2.14

[56] References Cited

U.S. PATENT DOCUMENTS

| | | | |
|---|---|---|---|
| 2,475,131 | 7/1949 | Edwards | 292/263 |
| 3,974,753 | 8/1976 | Blomgren et al. | 292/263 |
| 4,120,524 | 10/1978 | Buck, Jr. | 296/224 |
| 4,205,875 | 6/1980 | Smith | 296/218 |
| 4,206,939 | 6/1980 | Rowley, II | 292/263 |
| 4,226,052 | 10/1980 | Destepheno | 49/465 |
| 4,243,262 | 1/1981 | Tokunaga et al. | 296/201 X |
| 4,302,045 | 11/1981 | McAdams, Sr. | 296/224 |
| 4,394,044 | 7/1983 | Hough et al. | 49/465 |
| 4,468,064 | 8/1984 | McAdams, Sr. | 296/224 |
| 4,469,370 | 9/1984 | Petersen | 292/263 |
| 4,484,773 | 11/1984 | Lenne | 49/465 |
| 4,505,139 | 3/1985 | Richards | 70/224 |
| 4,535,613 | 8/1985 | Mastromatteo | 70/224 |
| 4,540,215 | 9/1985 | Swearingen | 296/224 |
| 4,637,649 | 1/1987 | Cambria | 70/221 |

FOREIGN PATENT DOCUMENTS

| | | | |
|---|---|---|---|
| 49983 | 4/1982 | European Pat. Off. | 296/224 |
| 3324949 | 1/1985 | Fed. Rep. of Germany | 296/118 |
| 50-16620 | 2/1975 | Japan . | |
| 850806 | 10/1960 | United Kingdom | 292/263 |

*Primary Examiner*—Eric K. Nicholson
*Attorney, Agent, or Firm*—Finnegan, Henderson, Farabow, Garrett & Dunner

[57] ABSTRACT

A window apparatus for a vehicle comprising a vehicle body, a window glass, a lock means provided on the window glass, and a link-type hinge means which is provided on the vehicle body and is connected to the window glass through the lock means. When the window glass is closed or opened at a predetermined angle, the window glass and the link-type hinge means are connected together by the lock means, thereby enabling the window glass to be retained. When the lock means is unlocked, the window glass is disengaged from the link-type hinge means, thereby enabling the window glass to be fully opened. Accordingly, it is possible to readily take out luggage or the like in the compartment from the window without the need to open the door of the vehicle from the outside. Further, the link-type hinge means in this apparatus is designed so that there is no fear of a lock handle moving when the window glass is to be closed. Thus, it is possible to smoothly engage the lock handle with the lock means.

6 Claims, 4 Drawing Sheets

WINDOW APPARATUS FOR VEHICLE

This application is a continuation of application Ser. No. 07/114,009, filed Oct. 29, 1987, now abandoned.

BACKGROUND OF THE INVENTION

1. Field of the Invention

The present invention relates to a window apparatus for a vehicle which enables the window glass to be fully opened.

2. Description of the Related Art

A typical conventional window apparatus for a vehicle has heretofore been arranged as shown in FIG. 5. More specifically, a link type hinge means 2 is secured at one end thereof to a vehicle body 1, and the other end of the hinge means 2 is secured to the right-hand end (as viewed in the figure) of a window glass 3 by means of a screw 4 through a connecting member 2*a*. The left-hand end of the window glass 3 is pivotally secured to the vehicle body 1 through a spring hinge 5 which is secured to the window glass 3 by means of a screw 6. The link-type hinge means 2 has two links which are expanded or folded to open or close the window glass 3 through a predetermined angle.

The prior art suffers, however, from the following problem. Since the window glass 3 is secured directly to the link-type hinge means 2, the degree to which the window glass 3 can be opened is limited disadvantageously. For this reason, when luggage or the like is to be taken out from the compartment, the door must be opened inconveniently.

SUMMARY OF THE INVENTION

In view of the above-described circumstances, it is an object of the present invention to provide a window apparatus for a vehicle which enables the window glass to be fully opened.

It is another object of the present invention to provide a window apparatus for a vehicle which is so designed that there is no fear of the link-type hinge means moving when the window glass is to be closed.

To these ends, the present invention provides a window apparatus for a vehicle, comprising: a vehicle body; a window member which may be a window glass retained on the vehicle body in such a manner that the window member is pivotal about one side edge of the vehicle body; retainer means disposed between the other end edge of the window member and the vehicle body and activated to pivot the window member through a predetermined angle with respect to the vehicle body; and canceling means disposed between the retainer means and the window member and activated to disengage the window member from the retainer means, thereby enabling the window member to pivot through an angle more than said predetermined angle with respect to the vehicle body.

The link-type hinge means may include a link, a lock handle which is pivotally supported at one end of the link and adapted to be engageable with the lock means, a base which is pivotally supported at the other end of the link and secured to the vehicle body, a hole provided in the base, an abutment portion formed on the base so as to be able to abut against the lock handle, and a handle pivotally supported on the lock handle and having an engagement portion engageable with the hole provided in the base.

By virtue of the above-described arrangement, when the window glass is closed or opened at a predetermined angle with respect to the vehicle body, the lock means connects together the window glass and the link-type hinge means to retain the window glass. When the lock means is unlocked with a key, the window glass is disengaged from the link-type hinge means, thereby enabling the window glass to be fully opened. When the window glass is to be closed, the lock handle is secured to the base and locked from moving. Therefore, the lock handle and the lock means are reliably engaged with each other.

The above and other objects, features and advantages of the present invention will become apparent from the following description of the preferred embodiment thereof taken in conjunction with the accompanying drawings.

DESCRIPTION OF THE PREFERRED EMBODIMENT

One embodiment of the present invention will be described hereinunder in detail with reference to the accompanying drawings.

Figure 1:
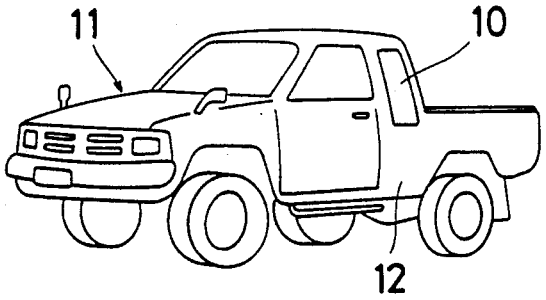
FIG. 1 shows a vehicle on which is provided one embodiment of the window apparatus according to the present invention.
Figure 2:
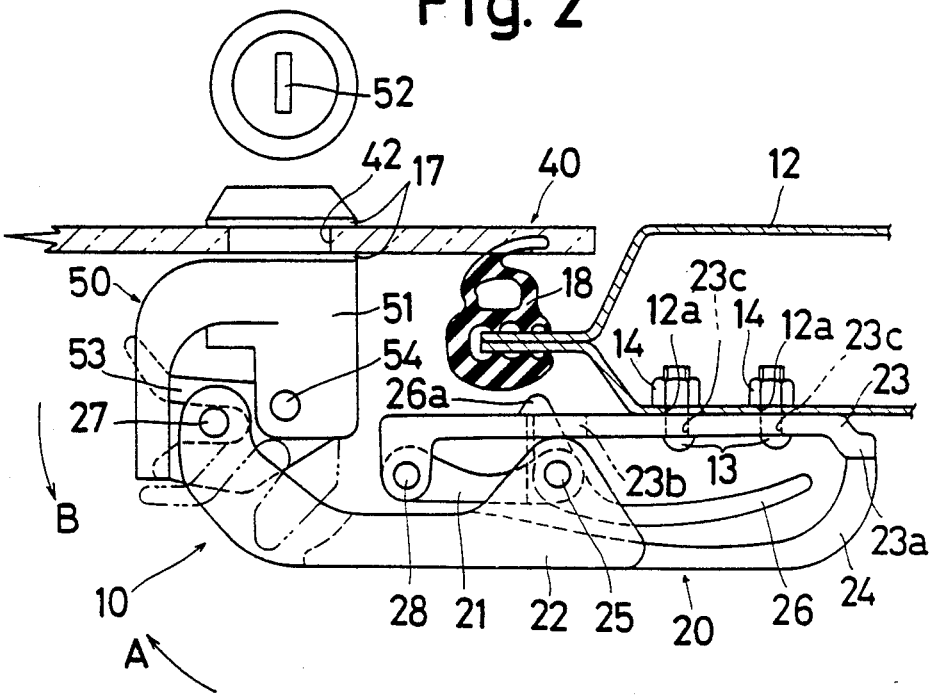
FIG. 2 is an enlarged view of an essential part of the window apparatus when the window glass is closed.
Figure 3:
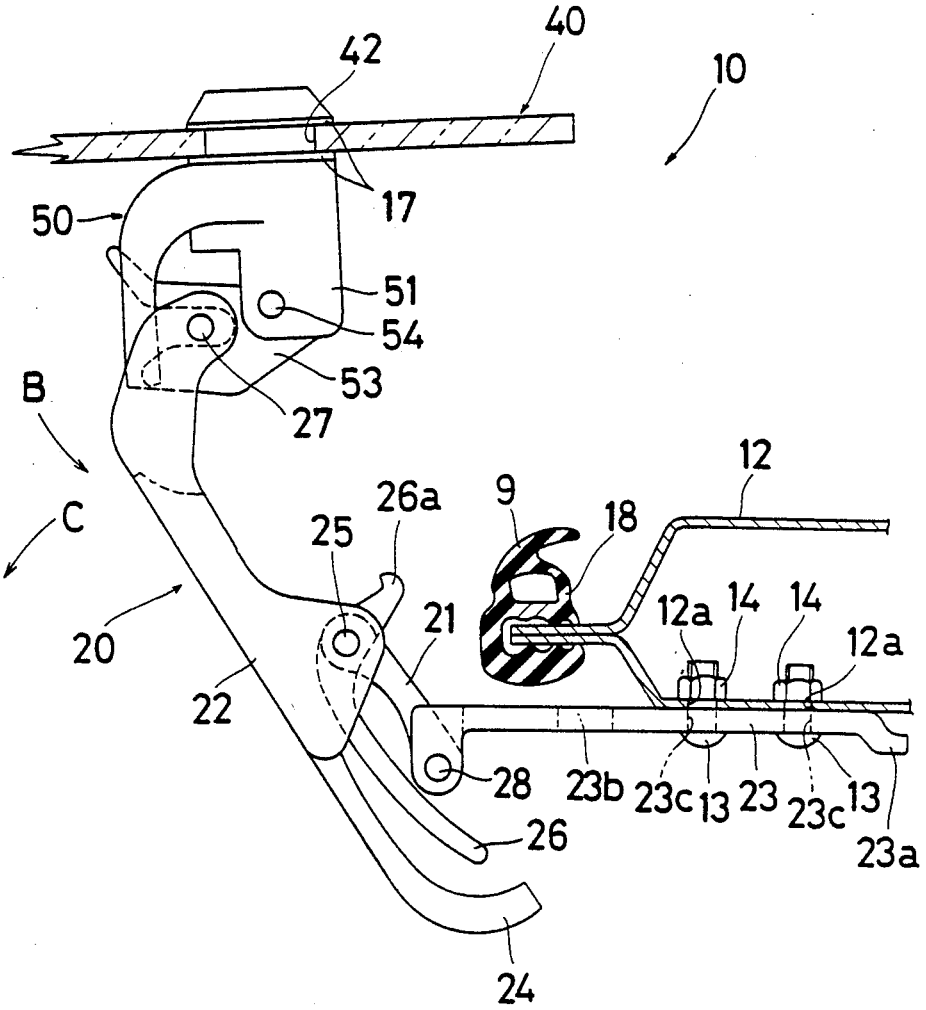
FIG. 3 is an enlarged view of an essential part of the window apparatus when the window glass is opened at a predetermined angle.
Figure 4:
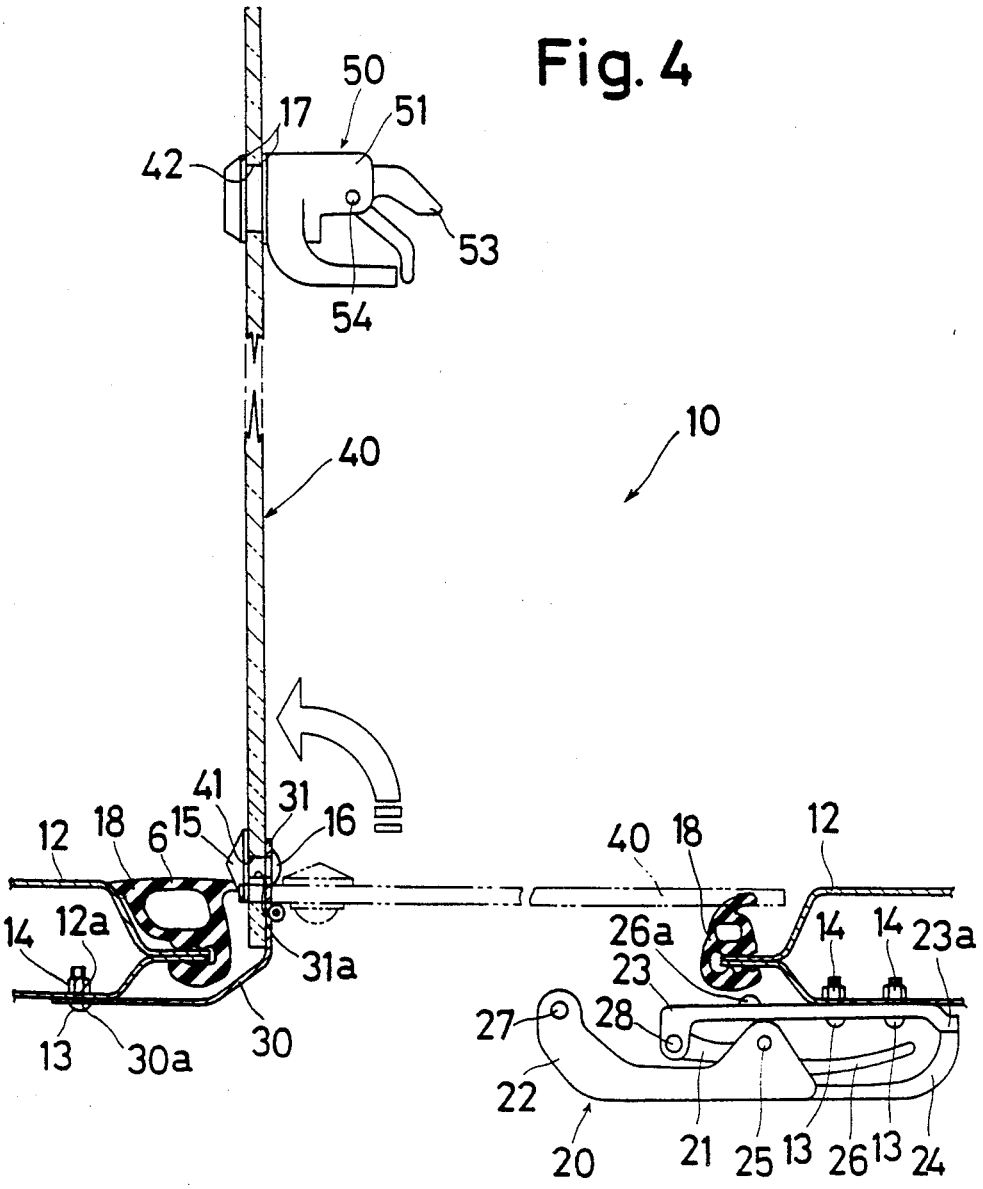
FIG. 4 shows an essential part of the window apparatus when the window glass is fully opened.
Figure 5:
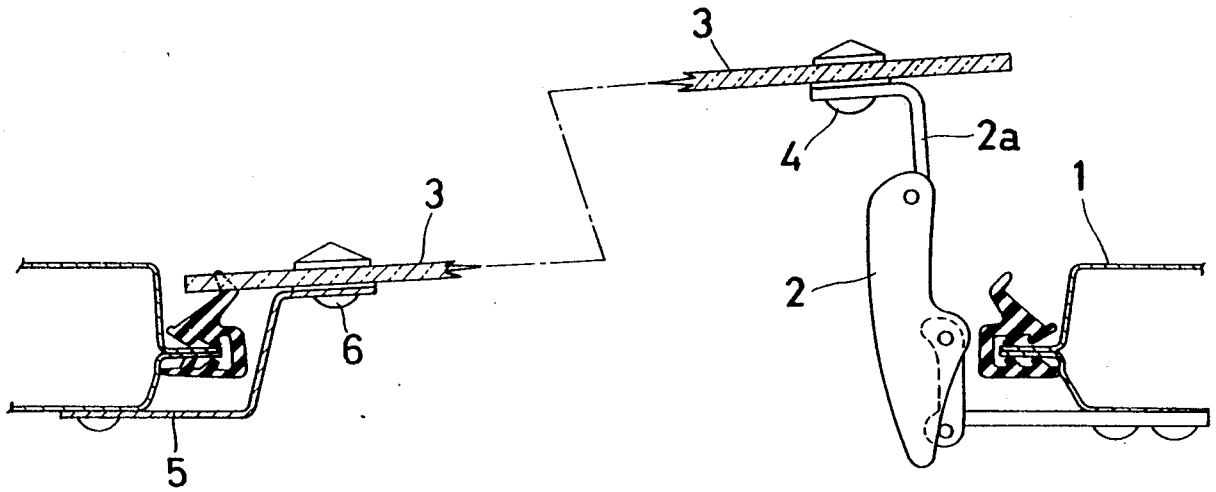
Fig. 5 (Prior art)
FIG. 5 shows a conventional window apparatus.

As shown in FIG. 1, a window apparatus for a vehicle according to one embodiment of the present invention which is generally denoted by the reference numeral 10 is mounted on the rear part of one side of an automobile 11. Referring to FIGS. 2 to 4, the window apparatus 10 comprises a link-type hinge means 20 and a hinge means 30 which are secured to a body 12 of the automobile 11, a window glass 40 pivotally secured to the hinge means 30, and a lock means 50 which is secured to the window glass 40 in such a manner that it can be engaged with and disengaged from the link-type hinge means 20 as desired.

The link-type hinge means 20 is, as shown in FIGS. 2 to 4, defined by a known toggle-type closing gear which consists of a link 21, a lock handle 22 which also serves as a link, and a base 23. An abutment member 24 is provided integral with the grip-side end portion of the lock handle 22. A shaft 27 is provided at the end portion of the lock handle 22 on the side thereof which is remote from the grip. Further, an abutment portion 23*a* is formed integral with the distal end of the base 23 so that it is able to abut against the abutment member 24 provided on the lock handle 22. A handle 26 which has an engagement portion 26*a* is pivotally supported by a shaft 25 which also supports both the link 21 and the lock handle 22 in such a manner that the link 21 and the lock handle 22 are rotatable relative to each other. The engagement portion 26*a* is engageable with a hole 23*b* which is provided in the base 23. The base 23 is further provided with bolt insertion holes 23*c*. Bolts 13 are respectively inserted into the holes 23*c* and further inserted into insertion holes 12*a* provided in the body 12, and nuts 14 are screwed onto the respective bolts 13, thereby securing the link-type hinge means 20 to the body 12. A hinge 31 is secured to one end of the window glass 40 in such a manner that a screw 16 is inserted into insertion holes 41 and 31*a* which are respectively provided in the window glass 40 and the hinge 31 and is then brought into thread engagement with a retainer 15. The hinge 31 is secured to the hinge means 30 in one unit, and the hinge means 30 is secured to the body 12 in such a manner that a bolt 13 is inserted into insertion holes 12*a* and 30*a* which are respectively provided in the body 12 and the hinge means 30. Thus, the window glass 40 which is secured to the body 12 is able to pivot through 90 degrees by the action of the hinge 31.

The lock means 50 is inserted through a sealing material 17 into a hole 42 which is provided in the other end portion of the window glass 40. The lock means 50 is defined by a known latch-type lock which is arranged such that a key (not shown) is inserted into a keyhole 52 in a key cylinder 51 and turned to thereby disengage a latch (not shown), thus causing a ratchet 53 to pivot counterclockwise about a shaft 54 to reach an unlocked state. The ratchet 53 of the lock means 50 is engageable with the shaft 27 provided on the lock handle 22 of the link-type hinge means 20 to reach a locked state.

The operation of the embodiment having the above-described arrangement will next be explained.

Referring to FIG. 2, when the window glass 40 is closed, the ratchet 53 of the lock means 50 for the window glass 40 is engaged with the shaft 27 provided on the lock handle 22 of the link type hinge means 20, and the window glass 40 is thereby locked. The lock handle 22 is secured to the base 23 through the engagement portion 26*a* of the handle 22 and the abutment member 24. The engagement portion 26*a* of the handle 22 is constantly biased in the direction in which the lock handle 22 is secured to the base 23 by the action of a spring which is provided on the shaft 25. In this state, the area between the window glass 40 and the edge of the body 12 on each side thereof which is closer to the hinge means 30 or the link-type hinge means 20 is sealed with a weatherstrip 18. When, in this state, the lock handle 22 is pulled indoors about the shaft 27 to disengage the engagement portion 26*a* from the hole 23*b* and then the lock handle 22 is pushed outdoors while being turned in the direction of the arrow A about the shaft 28 which pivotally supports the link 21 on the base 23, the window glass 40 is pivoted through a predetermined angle and held in a tilting position by the action of a spring (not shown) provided on the link-type hinge means 20 as shown in FIG. 3. In this state, the compartment can be ventilated When, in this state, the key is inserted into the keyhole 52 in the lock means 50 and turned, the ratchet 53 is unlatched and pivoted in the direction of the arrow B about the shaft 54, thus unlocking the lock means 50. In consequence, the shaft 27 is disengaged from the ratchet 53 and the window glass 40 is brought into a free state. Accordingly, it is possible to open the window glass 40 through up to about 90 degrees with respect to the body 12 by virtue of the hinge 31 as shown in FIG. 4. Since, at this time, the link-type hinge means 20 is brought into free state, it is moved in the direction of the arrow C shown in FIG. 3 by means of the biasing force from the spring. Thus, it is possible to take out luggage or the like in the reat part of the compartment from the window without the need to open the door (not shown) of the automobile 11. To return the window glass 40 to the position shown in FIG. 3, the user moves the link-type hinge means 20 with his hand to position where the ratchet 23 and the shaft 27 are able to fit to each other and engages the ratchet 53 with the shaft 27, thereby holding the window glass 40 in a tilting position. To return the window glass 40 to the position shown in FIG. 2, the user returns the link-type hinge means 20 to the closed position with his hand, engages the engagement portion 26*a* of the handle 26 with the hole 23*b* and also causes the abutment member 24 to abut against the abutment portion 23*a*, thereby holding the link-type hinge means 20 in a fixed state. Then, the user closes the window glass 40 and engages the ratchet 53 with the shaft 27, thus bringing the window apparatus 10 into a closed state.

As will be obvious from the foregoing, the window apparatus for a vehicle according to the present invention comprises a vehicle body, a window glass, a lock means provided on the window glass, and a link-type hinge means which is provided on the vehicle body and is connected to the window glass through the lock means. Accordingly, when the window glass is closed or opened at a predetermined angle, the window glass and the link-type hinge means are connected together by the lock means, thereby enabling the window glass to be retained. When the lock means is unlocked, the window glass is disengaged from the link-type hinge means, thereby enabling the window glass to be fully opened. Accordingly, it is possible to readily take out luggage or the like in the compartment from the window without the need to open the door of the vehicle from the outside. Since the window glass and the link-type hinge means are connected together by the lock means which is operated with a key, it is possible to prevent the user from being the victim of theft and therefore achieve a high level of safety. Further, the link type hinge means comprises a link, a lock handle which is pivotally supported at one end of the link to engage with and disengage from the lock means, a base which is pivotally supported at the other end of the link and which has a hole and is secured to the vehicle body, and a handle which has an engagement portion engageable with the hole provided in the base and which is pivotally supported on the base, wherein, when the window glass is in a closed state, the distal end portion of the grip of the lock handle is held in contact with the distal end of the base at all times. Accordingly, when the window glass is closed, the lock handle is secured to the base, and there is therefore no fear of the lock handle moving. Thus, it is possible to smoothly engage the lock handle with the lock means.

Although the present invention has been described through specific terms, it should be noted here that the described embodiment is not necessarily limitative and various changes and modifications may be imparted thereto without departing from the scope of the invention which is limited solely by the appended claims.

What is claimed is:

1. A window apparatus for a vehicle, comprising:

a vehicle body;

a window member having first and second opposite edges;

a first hinge means pivotally connecting the first edge of the window member to the vehicle body for enabling the window member to be pivoted from a closed position wherein said window member is substantially parallel to the vehicle body to a 90° angle with respect to the vehicle body;

retainer means disposed between the second edge of said window member and the vehicle body, said retainer means operable to pivot said window member within a predetermined angle with respect to the vehicle body; and canceling means disposed between said retainer means and said window member, said canceling means operable from the exterior of the vehicle to disengage said window member from said retainer means, thereby enabling said window member to be pivoted about said first hinge means to a 90° angle with respect to the vehicle body, said cancelling means operable from the exterior of the vehicle body when said window member is in the closed position.

2. A window apparatus for a vehicle according to claim 1, wherein said window member is a window glass.

3. A window apparatus for a vehicle according to claim 2, wherein said retainer means is a link-type hinge means which connects together said vehicle body and said window member and enables said window member to pivot within the predetermined angle.

4. A window apparatus for a vehicle according to claim 3, wherein said canceling means is a lock means which is activated with a key to rotate a ratchet, thereby unlocking said window member.

5. A window apparatus for a vehicle according to claim 4, wherein said link-type hinge means includes a link which is pivotally supported on said vehicle body, and a lock handle which is pivotally supported at one end of said link and adapted to be engageable with said lock means.

6. A window apparatus for a vehicle according to claim 5, wherein said link-type hinge means includes a link, a lock handle which is pivotally supported at one end of said link and adapted to be engageable with said lock means, a base which is pivotally supported at the other end of said link and secured to said vehicle body, a hole provided in said base an abutment portion formed on said base so as to be able to abut against said lock handle, and a handle pivotally supported on said lock handle and having an engagement portion engageable with said hole provided in said base.

* * * * *